US006427785B2

(12) United States Patent
Ward

(10) Patent No.: US 6,427,785 B2
(45) Date of Patent: Aug. 6, 2002

(54) SUBSURFACE MEASUREMENT APPARATUS, SYSTEM, AND PROCESS FOR IMPROVED WELL DRILLING, CONTROL, AND PRODUCTION

(76) Inventor: Christopher D. Ward, 2345 Bering Dr., Houston, TX (US) 77057

( * ) Notice: Subject to any disclaimer, the term of this patent is extended or adjusted under 35 U.S.C. 154(b) by 29 days.

(21) Appl. No.: 09/960,084

(22) Filed: Sep. 21, 2001

Related U.S. Application Data

(62) Division of application No. 09/618,984, filed on Jul. 19, 2000, now Pat. No. 6,296,056, which is a division of application No. 09/495,576, filed on Feb. 1, 2000, now Pat. No. 6,189,612, which is a division of application No. 09/042,590, filed on Mar. 16, 1998, now Pat. No. 6,148,912.

(60) Provisional application No. 60/042,047, filed on Mar. 25, 1997.

(51) Int. Cl.[7] ..... E21B 47/06; E21B 47/12

(52) U.S. Cl. ..... 175/48; 73/152.22; 73/152.46; 73/152.53; 166/250.07; 175/50

(58) Field of Search ..... 166/250.07, 250.08, 166/250.17; 175/40, 48, 50, 230; 73/152.22, 152.36, 152.38, 152.46, 152.51, 152.53

(56) References Cited

U.S. PATENT DOCUMENTS 3,182,725 A * 5/1965 Moore ..... 175/50 X
3,324,717 A * 6/1967 Brooks et al. ..... 175/48
3,439,740 A * 4/1969 Conover ..... 166/187 X
3,595,075 A * 7/1971 Dower ..... 175/48
3,809,170 A * 5/1974 Ilfrey et al. ..... 166/352
3,908,769 A * 9/1975 Schuyf et al. ..... 175/48
3,968,844 A * 7/1976 Walther et al. ..... 166/319
4,216,536 A * 8/1980 More ..... 166/254.2
4,430,892 A * 2/1984 Owings ..... 175/48
4,570,480 A * 2/1986 Fontenot et al. ..... 175/48
4,867,237 A * 9/1989 Wilson et al. ..... 166/250.07
5,080,182 A * 1/1992 Thompson ..... 175/48
5,337,821 A * 8/1994 Peterson ..... 166/250.07
5,540,280 A * 7/1996 Schultz et al. ..... 166/205.07
5,698,799 A * 12/1997 Lee, Jr. et al. ..... 175/230 X
5,803,186 A * 9/1998 Berger et al. ..... 166/250.17
6,109,367 A * 8/2000 Bischel et al. ..... 175/24
6,148,912 A * 11/2000 Ward ..... 166/250.07
6,189,612 B1 * 2/2001 Ward ..... 166/250.07
6,296,056 B1 * 10/2001 Ward ..... 166/250.07

* cited by examiner

*Primary Examiner*—George Suchfield

(57) ABSTRACT

Subsurface wellbore conditions are measured directly in the wellbore while the fluid circulation system is not pumping. The measured values are recorded at the subsurface location and subsequently transmitted to the well surface when circulation is resumed using fluid pulse telemetry (FPT). Real-time measurements made when the fluids are circulating are transmitted real time using FPT. Axially spaced measurements are used to obtain differential values. The apparatus of the invention comprises an assembly carried by a drill string that is used to selectively isolate the area within the well that is to be evaluated. The apparatus includes an assembly having axially spaced inflatable well packers that are used to isolate an uncased section of the wellbore. The apparatus is equipped with self-contained measuring and recording equipment, a fluid receiving reservoir, circulation valving, measurement while drilling equipment, and automated controls. Measurements are made while the circulation is terminated or while the well packers are being used to isolate an area of the wellbore from the circulating fluid. The method is used to directly measure and evaluate conditions caused by pumping and drill string movement, such as swab and surge pressures. Other conditions such as the formation strength, formation pressure, the fluid density, and other subsurface conditions related to the well are also measured.

12 Claims, 1 Drawing Sheet

SUBSURFACE MEASUREMENT APPARATUS, SYSTEM, AND PROCESS FOR IMPROVED WELL DRILLING, CONTROL, AND PRODUCTION

CROSS REFERENCE TO RELATED APPLICATIONS

The present application is a divisional of U.S. patent application Ser. No. 09/618,984 filed Jul. 19, 2000, now U.S. Pat. No. 6,296,056, which is a divisional of U.S. patent application Ser. No. 09/495,576 filed Feb. 1, 2000, now U.S. Pat. No. 6,189,612, which is a divisional of U.S. patent application Ser. No. 09/042,590 filed Mar. 16, 1998, now U.S. Pat. No. 6,148,912, which is related to Provisional Application No. 60/042,047 filed Mar. 25, 1997.

BACKGROUND OF THE INVENTION

1. Field of the Invention

The present invention relates to the field of well drilling and completion. More specifically, the present invention relates to direct measurement apparatus and methods for evaluating subsurface conditions in a wellbore.

2. Description of the Background Art

In a typical well drilling operation, conditions in the wellbore must be closely monitored and controlled to optimize the well operation and to maintain control of the well. One of the most important conditions in well drilling procedures is the bottomhole pressure of the circulating drilling fluid or "mud" used in forming or conditioning the well. The actual or effective density of the mud is an important condition that can be affected by a number of different variables related to the composition of the mud, the characteristics of the formation being penetrated by the wellbore, the dynamics of the drilling mechanism, and the procedures being implemented in the wellbore. In this latter regard, for example, the circulation of the fluid creates an effective density within the wellbore, referred to as an equivalent circulating density, that exceeds the static density of the fluid. The equivalent circulating density is caused by pressure losses in the annulus between the drilling assembly and the wellbore and is strongly dependent on the annular geometry, mud hydraulics, and flow properties of the well fluid. The maximum equivalent circulating density is always at the drill bit, and pressures of more than 100 psi above the static mud weight may occur in long, extended reach and horizontal wells.

This equivalent circulating density, which must be known in order to determine well pressures existing at different locations within the wellbore, may be calculated using hydraulics models from input well geometry, mud density, mud rheology, and flow properties, through each component of the circulating system. There are, however, often large discrepancies between the measured and calculated pressures due to uncertainties in the calculations through poor knowledge of pressure losses through certain components of the circulation system, changes in the mud density and rheology with temperature and pressure, and/or poor application of hydraulics models for different mud systems.

In many high pressure, high temperature (HPHT), deepwater, and extended reach and horizontal wells, the margin between the formation pore or collapse pressure and the formation fracture pressure often diminishes to the point that the equivalent circulating density can become critical. In extreme cases, the well may flow or cave in while the pumps used to circulate the mud are off ("pumps off"), allowing the well fluid to flow into the formation. Accurate determination of the actual static and dynamic mud pressures within the wellbore is therefore a critical design parameter for the successful drilling of these wells.

Another phenomenon affecting pressures in the wellbore results from movement of the drill string. As the drill string is lowered into the well, mud flows up the annulus between the string and the wellbore and is forced out of the flowline at the well surface. A surge pressure results from this movement, producing a higher effective mud weight that has the potential to fracture the formation. A swabbing pressure occurs when the pipe is pulled from the well, causing mud to flow down the annulus to fill the void left by the pipe. The pressure effectively reduces the mud weight and presents the potential for inducing a discharge of fluid from the formation into the wellbore. As with the equivalent circulating density measurements, the swab and surge pressures are strongly dependent on the running speed, pipe geometry, and mud rheology involved in the drilling or completion of the well. These pressures reach a maximum value around the bottom hole assembly (BHA), where the annular volume between the drilling string assembly and the surrounding wellbore is the lowest, and thus where flow through the well is the fastest.

Theoretical and experimental evidence suggests that during running pipe in and out of the wellbore, a much larger pressure differential is exerted on the formation than is experienced from static and circulating pressures during drilling, unless the pipe running speed is lowered significantly. Formation susceptibility to wellbore instability, although not problematic while drilling, may increase due to the swab and surge pressures incurred during tripping when the entire pipe string is rapidly withdrawn or reinserted in the well.

Modeling swab and surge pressure is difficult because of the manner in which the fluid flows as the pipe is moved within the well. A moving pipe causes the mud adjacent to the pipe to be dragged with it to a certain extent, although the bulk of the annular fluid is moving in the opposite direction. The mechanics are therefore different from the hydraulics calculations described for the mud circulation since, in that case, fluid flow is considered to be only moving in one direction. Swab and surge hydraulics models therefore require a "clinging constant" to account for the two relative motions.

A pressure surge caused by breaking the gels when increasing the flow rate too quickly after breaking circulation has been responsible for many packoff and lost circulation incidents. In this situation, where the well circulation is terminated for a period of time ("pumps off") and then reinitiated ("pumps on"), if the circulation rate is reinitiated too quickly, a pressure surge is created in the mud, causing a damaging imbalance with the formation. This danger, which is particularly evident in high angle wells, led to the procedure of slowly bringing the volume of the mud pumps up anytime after circulation is temporarily suspended. A pressure surge associated with restarting circulation may also be caused by a restriction in the annulus due to cuttings sagging and accumulating while the mud is static.

In extended reach and horizontal wells, hole cleaning can become critical. If parts of the wellbore are unstable, as in common in these types of wells, the accumulation of cuttings, beds, and an overloaded annulus make it difficult to clean the hole properly. Remedial measures, such as control drilling, the pumping of viscous pills, and wiper trips, are commonly employed in an attempt to avoid packing off and sticking the pipe. These procedures, however, consume valuable time and may also damage the formation leading to further wellbore instabilities.

Yet another situation where knowledge about the subsurface conditions is important occurs when drilling out of the bottom of a casing shoe into new formation. It is common to perform a leak-off test (LOT) to determine the strength of the cement bond around the casing shoe. However, because of the small margins between the formation pore or collapse pressure and fracture pressure in many wells, the LOT has become a critical measure of the formation strength and is used as a guide to the maximum allowable circulating pressure that may be used in a subsequent hole section without breaking down the formation and losing circulation in the well.

Conventionally, LOT pressures are recorded at the surface of the well. The measurements must be corrected for the pressure being exerted by the mud column. To obtain an accurate reading in these surface conducted measurement procedures, the mud must be circulated thoroughly to condition it to produce an exact and even density for the LOT calculation. This process can be time-consuming, and the calculated results are subject to the correctness of the information and assumptions used for the values of the variable conditions affecting the mud column density.

Subsurface pressure information is especially important when the well "takes a kick" during drilling. The term "kick" is commonly employed to describe the introduction of formation gas, a lower density formation fluid, or a pressured formation fluid into the wellbore. If not controlled, the kick can reduce the density of the drilling fluid sufficiently to allow the formation pressure to flow uncontrollably through the well and become a "blowout." In riserless offshore drilling, the kick can allow formation fluids to flow into the sea.

After the kick is detected and the well is shut in, the stabilized casing shut-in pressure and the stabilized drill pipe shut-in pressure are measured at the well surface and recorded. The drill pipe shut-in pressure is used as a guide in determining the formation properties. Since the formation fluid type is generally unknown, it is not possible to determine the formation pressure from the casing shut-in pressure. The formation pressure and influx volume are required to calculate the density of the mud required to "kill" the well. While circulating the kill mud, the annular pressure is controlled by the choke and pump speed to maintain a constant bottom hole formation pressure and prevent further entry of formation fluid. As with the other evaluations dependent upon fluid or mud pressure, the accuracy of the calculations is dependent upon the correct evaluation of the factors affecting the mud density.

Another situation that requires knowledge of the mud column density is that of determining the mud weight. The mud weight is normally determined at the well surface from surface mud checks or sensors in the flowline or the return pit. It has been proposed that the mud density actually decreases with temperature increases due to expansion and that this effect may become important in HPHT wells with tight margins between the formation pressure and the wellbore pressures. In high angle wells, a heavy cuttings load may increase the annular mud weight significantly. Additionally, a number of measurements can be made during a trip to detect barite sag, which also affects the mud weight.

A conventional pressure while drilling (PWD) tool can be used to measure the differential well fluid pressure in the annulus between the tool and the wellbore while drilling mud is being circulated in the well. These measurements are employed primarily to provide real-time data at the well surface, indicative of the pressure drop across the BHA for monitoring motor and measurement while drilling (MWD) performance. The measurement values are also affected by the effects of the circulating well fluid. Direct annular pressure measurements were not customarily made.

Downhole well pressures may also be measured directly using a drill-string-supported tool isolating a section of the wellbore from the effects of the well fluid above the point of measurement. U.S. Pat. No. 5,555,945 (the '945 patent) describes a tool that employs an inflatable packer with an MWD instrument designed to sense fluid pressure or temperature, or other variable well characteristics. The measurement is typically made in the annulus between the tool and the formation in the area below the set packer. The packer is set and the subsurface variable is measured and recorded in an instrument contained within an assembly of the tool. The recorded data is retrieved to the surface by pulling the drill string and assembly from the well. Constant remote communication may be maintained with a surface command station using mud pulse telemetry or other remote communication systems.

U.S. Pat. No. 5,655,607 describes a drill-string-supported, inflatable packer that can be anchored in an open wellbore and used to measure well pressures above or below the packer. An internal cable control is used to regulate inflation and deflation of the packer. Subsurface measurement data are presumably sent directly through the cable to the well surface or recorded and retrieved when the assembly is retrieved to the well surface.

In some MWD systems, downhole temperature and pressure, as well as other parameters, are measured directly, and the measured data values are communicated to the surface as the measurements are being made using "fluid pulse telemetry" (FPT), also called "mud pulse telemetry" (MPT). FPT, such as described in U.S. Pat. No. 4,535,429, requires that the well fluid be circulated to transmit data to the well surface. While data transmission during circulation of the well provides information on a timely basis, the measurements taken are affected by the fluid circulation and must be corrected for its effects. This requirement imposes the same uncertainties previously noted regarding calculated values for subsurface parameters, computer modeling, and surface measurement techniques used to estimate a subsurface condition.

It is also possible to directly obtain subsurface measured data using transmission techniques that do not rely on circulating well fluid. For example, subsurface measurement and transmitting devices using low frequency electromagnetic waves transmitted through the earth to a receiver at the surface are capable of transmitting data without regard to whether the well fluid is circulating or static. These devices, however, are not suitable for use in all applications and also require highly specialized transmitting and receiving systems that are not as commonly available as are the FPT systems.

MWD systems that use MPT are only able to send information to the surface while circulating. Thus, real-time pressure and temperature information can only be sent real time while circulating the mud system. However, much information useful to well drilling and formation evaluation processes can be gained from the data recorded while the pumps are off. While the pumps are off, pressure and temperature and other data are recorded at a specific sampling rate. On resumption of circulation, this stored information is transmitted to the surface using FPT. This may be as detailed as each discrete recorded sample. However, sending all data may take an unacceptable amount of time. Some smart processing downhole will reduce the amount of data that has to be sent up.

U.S. Pat. No. 4,216,536 (the '536 patent) describes a system that, among other things, uses the storage capacity in a subsurface assembly to store data measurements of a downhole condition made while the drilling liquid is not circulating. The stored data is transmitted to the well surface after flow of the drilling liquid is resumed using FPT. Subsurface temperature and formation electrical resistivity are examples of the conditions sensed and recorded while the circulation of the drilling fluid is interrupted. The '536 patent also discloses a method for increasing the effective transmission rate of data through FPT by deriving and transmitting condensed data values for the measured conditions. The '536 patent employs multiple transducers on a logging tool for measuring a number of downhole conditions.

U.S. Pat. No. 5,353,637 (the '637 patent), describes multiple, axially spaced inflatable packers included as part of a wireline or coil tubing supported sonde that is used to conduct measurements in cased or uncased boreholes. The '637 patent system measures conditions in the wellbore between axially spaced inflatable packers and sends the measurement values to the surface over the supporting wireline cable.

The '945 patent, previously noted, describes methods and apparatus for early evaluation testing of subsurface formation. A drill-string-supported assembly that includes one or more well packers and measuring instruments is used to measure subsurface pressures. Recorded measurements are accessed by retrieval of the drill string or connection with a wireline coupling. The system may also provide constant remote communication with the surface through mud pulse telemetry.

SUMMARY OF THE INVENTION

The present invention provides methods and apparatus for directly measuring a subsurface well condition, transmitting the measured condition values to the well surface using FPT, and evaluating the transmitted data to determine the value of a well condition at a location in the well remote from the well surface.

One method of the present invention measures a subsurface pressure directly while the circulating fluid system is off, records the measured values, transmits the recorded pressure values to the well surface when circulation is resumed using FPT, and evaluates the received data to determine such conditions as casing cement integrity, kick tolerance of a newly drilled borehole section, openhole fracture strength, and formation pressure.

The method of the present invention is employed to determine surge and swab pressures by measuring and recording "pumps off" pressure changes caused by pipe movement and fluid flow rate increases. The measured values are recorded while the pumps are off and transmitted to the well surface when circulation is resumed using FPT. The received data are employed to adjust the speed of pipe movement or the rate of pumping to maintain well fluid pressures at optimum values as the pipe is being pulled or run and/or as the pumps are being started back up after a period of "pumps off."

The methods of the invention are also employed to determine subsurface mud weight, cuttings, volumes, and other solids content of the well fluid, and to determine an equivalent circulating mud density.

In one method of the invention, measurements made while the fluid system of the well is circulating, or not, are taken at axially spaced locations in the wellbore to detect a pressure differential. Measurements taken with the pumps off are recorded. The measurement data are sent to the well surface using FPT. Circulating pressure measurements are recorded or are transmitted to the surface as they are taken using FPT. The received data are used to detect the occurrence of a kick or to monitor mud rheology or solids content of the circulating mud. Circulating and non-circulating measurements are used to determine the pressure effect of circulation on the wellbore.

The present invention also employs a method of directly measuring subsurface well conditions in an area of the wellbore that is temporarily freed from the effects of circulating well fluids to obtain true subsurface condition values. Where the area being measured is isolated from the circulating fluid by an isolation packer during "pumps on," the measured data may be transmitted real time through the circulating fluid using FPT. In another method of the invention, measurements are made in an isolated part of the wellbore, the measurements are recorded, contact with the circulating well fluid is reestablished, and the recorded data is transmitted to the well surface using FPT. In either application, conventional FPT systems may be employed in a pumps off condition and/or in combination with an isolating well packer and subsurface recorder and measuring devices to obtain direct measurement of subsurface well parameters free of the effects of the well fluid used in the well's circulation system.

The apparatus of the invention comprises a drill-string-carried assembly that is employed to perform MWD measurements, as well as to selectively isolate the subsurface well area to be evaluated. The preferred form of the invention includes two axially spaced inflatable well packers, either one of which, or both, may be used to isolate a section of the wellbore. The assembly is equipped with axially spaced measuring instruments, recording equipment, a fluid receiving reservoir, valves, and control equipment that may be actuated from the well surface.

The apparatus may be used to directly measure the swab and surge pressures caused by drill string movement, the surge pressure caused by the initiation of fluid circulation, the formation strength, the formation pressure, the downhole fluid density, the effectiveness of kill fluids being added to the circulation system and other subsurface variables related to the condition of the well. Data measured and/or recorded at the subsurface location are sent by FPT to the well surface through the circulating well fluid.

The apparatus of the present invention is the provided with axially spaced sensors, such as PWD sensors or temperature sensors, to provide simultaneous measurement of wellbore conditions at axially spaced locations either with the packers set or unset. The differential in the spaced measurements is used to evaluate subsurface wellbore conditions. The measured values may be transmitted to the well surface as they are being taken using FPT, or they may be taken in a static or isolated area of the well fluid and recorded for subsequent transmission using FPT when communication with circulating fluid is reestablished.

From the foregoing, it will be appreciated that a primary object of the present invention is to measure and record subsurface well conditions within an area of the wellbore, free from the effects of fluid circulating in the circulation system of the well, and transmit the recorded data to the well surface using FPT for directly evaluating one or more subsurface conditions without having to correct for the effects of the circulating well fluids.

Another object of the present invention is to provide an apparatus carried by the drill string that may be employed to isolate a section of the wellbore with one or more inflatable packers, measure, and record variable well conditions within the isolated section, and transmit the recorded data to the well surface using FPT.

Yet another object of the present invention is to provide a method of directly measuring subsurface pressure, temperature, and/or other variables within a wellbore at axially spaced positions within the wellbore to obtain differential values of such variables and transmitting the measured values to the well surface using FPT while the pumps are on or after circulation of the well fluids is reestablished.

Yet another object of the present invention is to provide a method for directly measuring the effects of pressure changes induced in a wellbore due to the movement of the drilling string assembly within the wellbore, to record the changes, and to transmit the recorded data through the well fluids using FPT.

An important object of the present invention is to provide a drill-string-carried tool having provision to isolate a section of a wellbore from the well fluids in the bore, receive formation fluids in a reservoir chamber included in the well tool and measure variable parameters of the entry of such formation fluids into the chamber, record such measurements, and subsequently transmit the recorded measurements to the well surface using FPT.

An object of the present invention is to provide a drill-string-supported assembly that can isolate a section of a wellbore, receive fluids from the formation in the isolated section of the wellbore, measure variable characteristics regarding the fluid being received from the formation, record such measured characteristics, and subsequently transmit the recorded characteristics to the well surface using FPT.

Another object of the present invention is to provide a subsurface assembly included as part of a drilling string assembly for isolating a section of a wellbore from the circulating fluids within the well, such assembly having expandable packer seals that are normally protected within a wear protecting sleeve that may be displaced from the packer seal to permit engagement of the seal with the surrounding formation.

It is an object of the present invention to provide a composite subsurface tool, carried by a drill string and included as part of a drilling assembly comprising dual, axially spaced inflatable packers that can be expanded radially to seal off the wellbore area between the packers, protective covering over the packers that is displaced when the packers are to be expanded, a circulating sub above the uppermost packer for circulating well fluids while an area of the wellbore is isolated, a receiving chamber for accepting fluid flow from the formation in the isolated wellbore area, an FPT module for conveying data to the well surface through the circulating well fluids, a measurement system for measuring wellbore conditions, a recording system for recording measured values, and a self-contained control system responsive to well surface commands for initiating setting and release of the well packers and for controlling the taking, recording, and transmission of measurement values.

DESCRIPTION OF THE EMBODIMENTS

Figure 1:
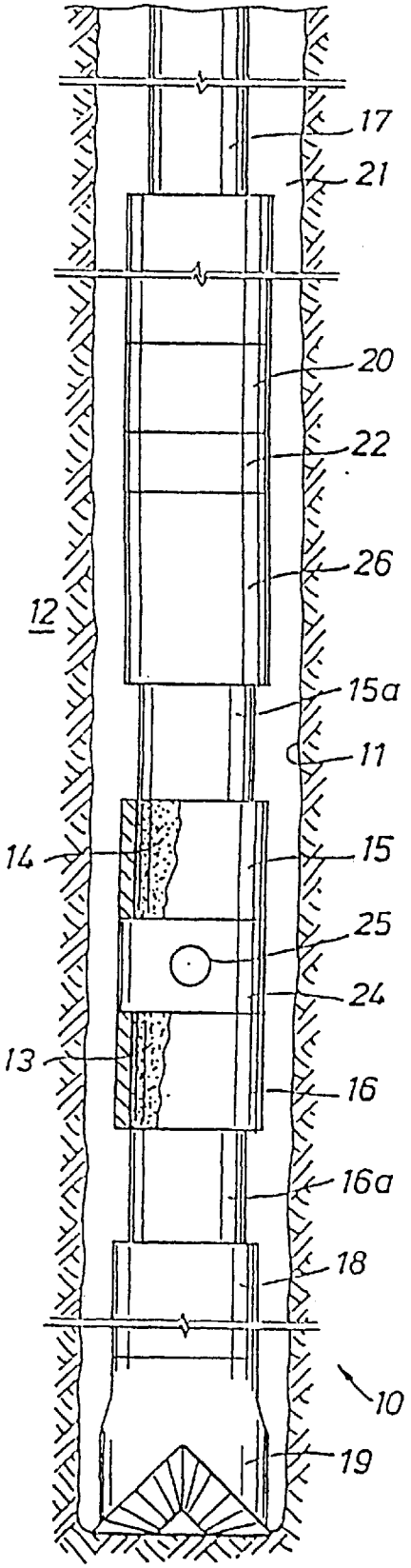
FIG. 1 is an elevation, partially in section, illustrating the drill-string-supported tool of the present invention within a wellbore before inflation of the inflatable well packers.

Enhanced Leak-off Test (LOT) and Pressure Integrity Test (PIT) and Formation Integrity Test (FIT) Using Direct Pressure Measurement In a typical LOT, the start of each well section, after casing and cementing the wellbore, a short interval (approximately 3 m) of new hole is drilled below the casing shoe. The well is then shut in and the wellbore pressured up by pumping at a slow rate until the wellbore strength is exceeded and mud starts to leak off (LOT) or until a specified pressure is achieved (PIT/FIT). These pressures are monitored from the well surface. This test is used to verify the casing cement integrity, the kick tolerance for the next section, and an estimate of the openhole fracture strength.

Because of the small margins between pore or collapse pressure and fracture pressure in many HPHT, deepwater, and extended reach/horizontal wells, the LOT has become a critical measure of the formation strength and is used as a guide to the maximum allowable circulating pressure in the subsequent hole section to prevent lost circulation.

LOT pressures are recorded at surface usually by the cement unit but should be corrected for the pressure exerted by the mud column. The mud is therefore usually circulated thoroughly an hour or two to condition it and to measure the exact and even density for the LOT calculation.

In the method of the present invention, a downhole pressure tool measures directly or isolates and then measures and records the LOT pressure close to the formation, thus removing the ambiguities of the prior art method, resulting in more accurate determination of the formation strength. The recorded data are sent to the well surface through the circulating well fluid using FPT. The LOT pressure is measured without first circulating an even mud weight, and the measurement is taken using a PWD instrument that provides direct subsurface measurements with quicker and more accurate determinations. Because the PWD is located downhole next to the formation, the measurements are accurate, and the uncertainties of measuring at surface that are caused in part by the compressibility and transmissibility of pressure through a gelled mud system over thousands of meters are eliminated.

The method for the LOT, PIT, and FIT procedures are:

1. Shut in the well.
2. Pressure the wellbore slowly until a specified pressure is reached or the wellbore strength is exceeded.
3. Record the bottomhole pressure of the well fluid during step 2.
4. Resume circulation in the wellbore.
5. Transmit the recorded pressure data to the well surface using FPT.
6. Evaluate the received data to determine subsurface formation conditions.

Swab and Surge Pressures Caused by Pipe Movement

The steps of the method to determine surge and swab pressure caused by pipe movement are as follows:

1. Terminate circulation of the mud.
2. Measure and record the subsurface pressure changes occurring in the mud as the pipe is moved (pulled, run, and/or rotated).
3. Resume circulation.
4. Transmit the recorded pressure values to the well surface using FPT.

5. Evaluate the transmitted values to establish pipe movement rates that will not cause undesired pressure changes in the wellbore.

Effective Downhole Mud Weight Measurements

The mud weight at a subsurface location in the wellbore is directly determined by the following method steps:

1. Terminate mud circulation.
2. Measure and record the mud pressure at the subsurface location.
3. Resume circulation of the mud.
4. Transmit the recorded pressure values to the well surface using FPT.
5. Evaluate the transmitted pressure values to determine the mud weight at the subsurface location.

The solids content of the well fluid at the subsurface location may also be determined from the subsurface mud weight by comparing the measured weight with that of the mud that has a known solids content. This data can be used to evaluate hole cleaning as well as other conditions of the well drilling operation.

Optimizing Speed of Pump Resumption Using "Pumps on" Pressure Surge Indicator

The thixotropic nature of mud systems gives them a tendency to gel to varying degrees when circulation is stopped. This gelling process tends to increase with mud viscosity and time. Care must be taken on resumption of circulation, while breaking the gels, not to put excessive pressures on the formation, which may threaten the formation integrity and lead to mud losses. Often the pumps and pipe rotation are brought up slowly in order to mitigate this problem. The rates of pumping and rotation change are based on estimates and experience rather than an exact knowledge of the surge pressures being produced.

Many packoff and lost circulation incidents have been attributed to a pressure surge caused when increasing the flow rate too quickly after breaking circulation. This is particularly common in high angle wells. A pressure surge may also be caused by a restriction in the annulus due to cuttings sagging and accumulating while the mud is static. Alternatively, the surge may represent the additional pressure needed to overcome the gel strength of the mud.

In the method of the present invention, "pumps off" PWD information is used to recognize the magnitude of the "pumps on" pressure surge. Once pumping is resumed, the measured and recorded data are sent to the well surface through the circulating well fluid using FPT. The data received at the surface are used to optimize the speed of the pumps and pipe rotation immediately after resuming circulation and pipe movement to prevent overpressuring the wellbore.

The method steps are:

1. Stop circulation of the mud.
2. Measure and record the bottomhole static mud pressure.
3. Resume circulation while continuing to measure the bottomhole pressure.
4. Record or transmit the circulating pressure values.
5. Transmit the recorded and any real-time pressure data to the well surface using FPT.
6. Evaluate the received data to establish the preferred rate at which circulation is to be resumed.

Kick Detection and Kill Monitoring PWD Using PWD Measurement Tools

The existing PWD tool, already in commercial use, is used to detect "kicks" caused by the influx of formation fluids (water, oil, or gas) to the wellbore. A dual, annular PWD device having axially spaced well packers according to the present invention is used for enhanced kick detection and other potential benefits.

Use of a downhole PWD information is used to detect kicks earlier than possible using surface measurement information to significantly increase drilling safety and avoid kick-related drilling problems.

Because the density of gas (0.2 sg) or oil (0.7 sg) or water (1.0–2.25 sg) is usually less than that of the drilling fluid (1–2 sg), the presence of a kick can be recognized by a reduction in PWD annular pressure. Because the measurement is downhole, it is observable earlier than when indicated by surface information. In the case of shallow salt water flows drilled with seawater, kicks may be recognized by increase in downhole measured pressure due to the formation pressure itself and the suspension of solids (loose sand). If the kick type is known (water, oil, or gas), the volume of the influx can be estimated from the degree of pressure change. The pressure is directly measured downhole so that it is an accurate measurement, and the measurement is transmitted to the surface so that it is obtained quickly.

If a kick is identified, the well is usually shut in with the blowout preventer (BOP) to prevent further influx. The stabilized casing shut-in pressure (CSIP) and stabilized drill pipe shut-in pressure (DPSIP) are recorded. The DPSIP is used as a guide to determining the formation condition properly. Since the formation fluid type and the influx volume are generally not accurately known, it is not possible to determine the formation pressure from the CSIP. The formation pressure is required to calculate the density of the kill mud required. The well is then circulated through the BOP at a slow rate to replace the well with a kill mud of higher density to balance the higher pressures. During this process, a constant bottom hole pressure is applied to the system by adjusting the choke pressure. This bottom hole pressure must be above the formation pressure to prevent further influx and below the fracture pressure to prevent losses. In conventional surface measuring systems, uncertainties due to lack of knowledge about the influx type and the volume of influx can lead to error in calculating the bottom hole pressure. PWD monitoring enables the bottom hole pressure to be measured directly and to be promptly received so that the choke pressure can be adjusted accordingly. The results of the adjustment are also correctly and quickly obtained.

An enhancement to the conventional PWD kick detector is the addition of a second PWD measurement downhole. A single PWD tool measures the average fluid density and pressure loss in the hole annulus. In a dual PWD system of the present invention, the pressure gradient between the two PWD tools is a downhole density measurement that picks up changes in density downhole due to a kick much more quickly. This dual PWD has other important applications such as downhole mud weight determination to better monitor cuttings loading and barite sag. It may also be used to estimate the downhole mud rheology.

In the method of the invention, circulating well fluid pressure values are taken simultaneously at spaced locations within the wellbore. The measured values are transmitted to the surface using FPT. The values are compared to evaluate the pressure differential between the measurement points. The size of the pressure differential is used to indicate the occurrence of a kick or the solids content of the mud or other aspects of the mud rheology. Measurements taken and recorded while the pumps are off or taken in an isolated section of the wellbore are sent to the surface using FPT.

In the method of the invention, a downhole pressure sensor measures formation fluid pressure in the presence of a float sub. The recorded data are transmitted to the surface using FPT. The tool and method provide actual bottom hole pressure measurement during the well kill operation.

Apparatus and System for Repeat Subsurface Testing, Measurement, and Recording While Drilling The tool of the present invention is indicated generally at 10 in FIG. 1. The tool is illustrated disposed in a wellbore 11 that penetrates a subsurface formation 12. As illustrated best in FIG. 2, the tool 10 includes two axially separated inflatable well packers 13 and 14 that may be actuated to expand radially to a set position at which they seal the tool to the surrounding wellbore 11. The packers 13 and/or 14 function as a subsurface isolation control mechanism for isolating an area from the effects of circulating well fluids.

The construction and operation of inflatable packers are well known. See, for example, U.S. Pat. No. 3,850,240, describing an inflatable drill string well packer used in an assembly to collect well fluid samples. See also the '637 patent, which describes axially spaced packers supported by a wireline or coil tubing string.

A retractable metal sleeve 15 covers the packer 14 while the packer is in its unexpanded state, illustrated in FIG. 1. A similar retractable sleeve 16 covers the unexpanded packer 13. When the packers are actuated to set, the sleeves 15 and 16 retract axially to the reduced radius areas 15*a* and 16*a* formed on the tool 10 to permit the packers to expand. The sleeves return to the positions illustrated in FIG. 1 when the packers are unset. The tool 10 is carried by a drill string 17 that extends to the well surface (not illustrated). In the form of the invention illustrated in FIGS. 1 and 2, the tool 10 is part of a BHA that includes one or more drill collars 18 carried over a rotary drill bit 19.

The tool 10 is provided with a pulsar subassembly (sub) 20 that produces data communicating pressure pulses in well fluid 21 that surrounds the tool 10. A circulation sub 22 is included in the tool 10 to be used to circulate well fluid through the wellbore above the isolated wellbore section when the packers 13 and/or 14 are set.

An isolated area 23 between the set packers 13 and 14 communicates with an MWD sub 24 used as a system control that provides power, measuring and recording, and flow control for the tool 10. The instruments of the sub 24 measure the variable parameters in the adjacent annular bore area 23. Fluid in the area 23 is selectively transmitted through the sub 24 through a port 25 to a pump-out module sub 26 positioned between the packer 14 and the circulating sub 22. The MWD module 24 provides system power and the control mechanisms used, for example, for initiating packer setting and release and for measuring and recording subsurface variables in response to surface-directed instructions. Examples of mechanisms and techniques capable of use as the system power and control mechanism of the MWD module 24 may be found in the description of the '536 and the '637 patents. Any suitable power and control techniques and mechanisms may, however, be employed to regulated the operation of the packer, instrument, and flow control components of the tool 10. Recorded or real-time data measured by the sub 24 is transmitted to the pulsar sub 20 for communication to the well surface when the well fluids are being circulated.

Two openhole drill string packers are employed, in the preferred form of the invention, above and below the PWD tool. However, certain of the methods of the invention may be performed using a tool having only a single packer.

The sleeves 15 and 16, which may be constructed of steel or other suitable material, are provided for packer protection as the drill string is rotated during drilling. Rubber packers are susceptible to wear during drilling unless the gauge is protected. The volume of fluid and fluid pressure within the packers 14 and 15 is selected to ensure sealing of the packers in enlarged boreholes. In operation, the pressure in the packer must be higher than the pressure in the test interval to ensure a proper seal.

Figure 2:
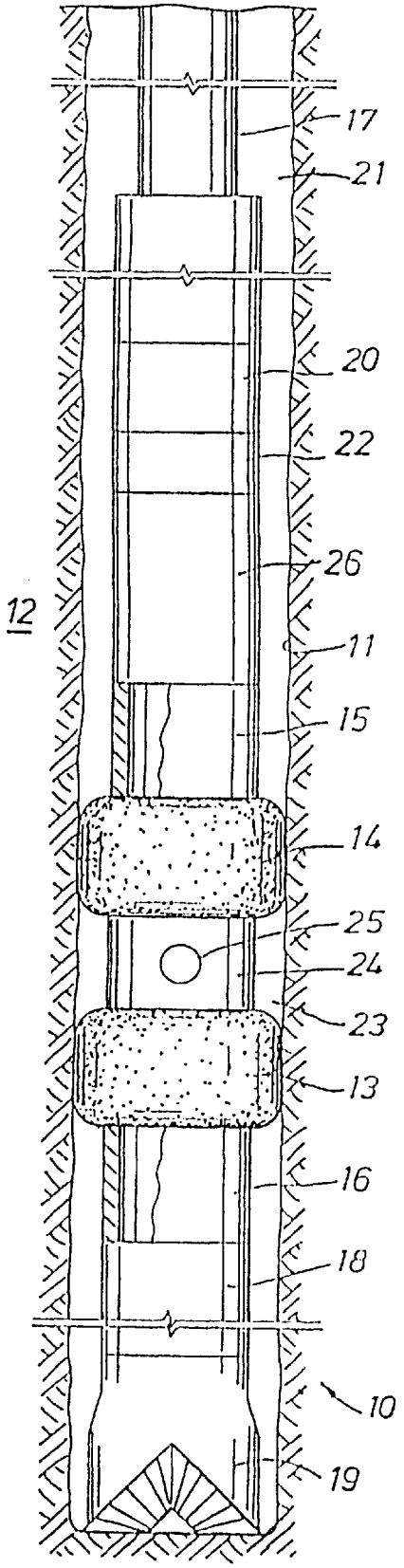
FIG. 2 is a view of the tool of FIG. 1 illustrating the packers inflated into engagement with the wall of the surrounding wellbore.

In the embodiment of FIGS. 1 and 2, the measured values taken by the measuring instruments in the area below the packer 14 may be communicated through the set packer 14. This permits real-time MPT capabilities while measurements are being made in an area free of the effects of the circulating well fluid.

Fluid is pumped in and out of the test interval to perform LOTs and RFTs. The draw-down and test are automated under the control of the module 24. The top openhole packer 14 may be used as a pump-out reservoir.

The circulating sub 22 may be employed for real-time monitoring with MPT tools. The circulating sub 22 is not needed for recorded tests or if EM telemetry is used.

The tool 10 may be employed in the following procedure to obtain real-time formation pressure:

1. Align the MWD sub 24 across a suitable interval, ideally across zones selected with formation evaluation measurement while drilling (FEMWD).
2. Inflate the openhole packers 13 and 14.
3. Circulate through the circulation sub 22 above the top packer 14.
4. Draw down the annular pressure in the area 23 between packers 13 and 14.
5. Monitor the real-time formation pressure with MWD 24 and transmit measured values to the surface through the pulsar sub 20 using FPT.
6. Deflate the packers 13 and 14 and close circulation sub 22.
7. Resume drilling or testing.

The advantages over a pad-type device such as used on a wireline tool are as follows:

1. Larger area of formation is tested.
2. A quicker and more reliable test; more likely to get a seal with the formation.
3. The tool is less likely to get differentially stuck; a quick test; no metal parts against the formation.
4. A gross permeability measurement is possible; a larger area of formation can be tested.
5. Accurate placement of the tool is combined with FEMWD; less likelihood of getting a time-consuming low permeability tight test, particularly in thin beds.
6. Early detection of proper packer seal since no draw-down is possible if the seal is not properly set.
7. Reliable RFTs in low permeability formations.

Benefit of Isolating the Test Area

The underbalanced situation in the annulus is controllable by the mud column being in overbalance (if it were underbalanced in a permeable formation, it would flow). The pressure draw-down using the tool of the present invention is only in a small annular volume and does not impact the hydrostatic head for the whole column. If the formation is tight but underbalanced as determined by the tool 10, control measures (i.e., kill mud, bullheading) may be employed.

If the packer fails during the test, then no draw-down occurs and essentially only mud weight is measured during the test. Only a small volume of fluid needs to be pumped out to get sufficient draw-down. If this is not happening, the test can be stopped.

Development wells are normally drilled overbalanced. However, in exploration drilling, large underbalanced or overbalanced situations may develop without warning. In such cases, the risk factor obtained by getting early RFTs outweighs concerns over taking the RFT.

Rig heave on floaters will employ good compensation to stop packers from moving.

Mud-cake: a pad-type RFT device has a probe with a filter to get through the mud cake skin. The large chamber area and the draw-down of a PWD RFT overcome the mud cake.

Openhole Leak-off Test (LOT) Using the Isolation Tool

An LOT below the shoe can now be measured at the surface and downhole using the PWD of the present invention. This is useful when the shoe has just been drilled out and there is a small openhole volume. To be able to record the formation strength in the open hole as drilling progresses is a significant improvement. The LOT using the isolation tool of the present invention may be performed as follows:

1. Align the MWD sub 24 over the interval of interest, picked by FEMWD.
2. Inflate the openhole packers 13 and 14.
3. Circulate through the circulation sub 22 above the top packer 14.
4. Pressure up an annular volume between the packers 13 and 14.
5. Monitor the real-time LOT and report the measured data to the well surface using FPT.
6. Deflate the packers 13 and 14 and close the circulating sub 22.

Advantages Over Standard LOT

1. Saves time circulating an even mud weight before the test (typically one hour).
2. Provides a more accurate test when measured at surface than when measured downhole (no compressing mud and breaking gel pressure to overcome).
3. Multiple LOTs are possible to assess the strength of weak formations. The equivalent circulating density (ECD) can then be limited to prevent lost circulation.
4. Used as a casing setting depth decision tool (in a strong rock), allowing additional kick tolerance in the following section.
5. Only breaks down the small volume of rock between the packers.

Fracturing and Stimulation

An extension of the LOT described above can effectively fracture the rock. The uses of this are:

1. Test-fracture-test to measure the effectiveness of the stimulation technique.
2. Measure water injection rates.
3. Test other stimulation techniques such as acidization and propped fractures.

The foregoing description and examples illustrate selected embodiments of the present invention. In light thereof, variations and modifications will be suggested to one skilled in the art, all of which are in the spirit and purview of this invention.

What is claimed is:

1. A method of evaluating a condition in a fluid-filled wellbore at a location remote from the well surface in a well having a well fluid circulating pumping system comprising:

terminating fluid circulation by said pumping system;

measuring the pressure of the fluid in said wellbore at said remote location adjacent a moving drill string assembly while the fluid circulating is terminated;

recording the measured pressures with a recorder carried by said drill string assembly;

initiating fluid circulation of fluids through said drill string assembly;

transmitting the recorded pressure values from said recorder to the well surface through said circulating fluid using fluid pulse telemetry; and adjusting the rate of movement of said drill pipe assembly based on said transmitted values to maintain desired pressure conditions in said wellbore as said drill pipe is being moved.

2. A method as defined in claim 1 wherein said movement is the rotation of said drill string assembly.

3. A method as defined in claim 1 wherein said movement is the axial movement of said drill string assembly through said wellbore.

4. A method as defined in claim 2 wherein said movement further comprises the axial movement of said drill string assembly through said wellbore.

5. A method of evaluating a condition in a fluid-filled wellbore at a location remote from the well surface in a well having a well fluid circulating pumping system comprising:

terminating fluid circulation by said pumping system;

measuring the pressure of the fluid in said wellbore at said remote location adjacent a moving drill string assembly while the fluid circulating is terminated;

transmitting the measured pressure values to the well surface; and adjusting the rate of movement of said drill pipe assembly based on said transmitted values to maintain desired pressure conditions in said wellbore as said drill pipe is being moved.

6. A method as defined in claim 5, wherein said movement is the rotation of said drill string assembly.

7. A method as defined in claim 5, wherein said movement is the axial movement of said drill string assembly through said wellbore.

8. A method as defined in claim 6, wherein said movement further comprises the axial movement of said drill string assembly through said wellbore.

9. A method as defined in claim 5, further comprising:

recording the measured pressures with a recorder carried by said drill string assembly; and transmitting the recorded pressure values from said recorder to the well surface.

10. A method as defined in claim 9, wherein said movement is the rotation of said drill string assembly.

11. A method as defined in claim 9, wherein said movement is the axial movement of said drill string assembly through said wellbore.

12. A method as defined in claim 10, wherein said movement further comprises the axial movement of said drill string assembly through said wellbore.

* * * * *